US010746385B2

(12) United States Patent
He et al.

(10) Patent No.: US 10,746,385 B2
(45) Date of Patent: Aug. 18, 2020

(54) LIGHTING DEVICE WITH WIRELESS CONTROL ELEMENT

(71) Applicant: SIGNIFY HOLDING B.V., Eindhoven (NL)

(72) Inventors: Yemei He, Eindhoven (NL); Wei Gu, Eindhoven (NL); Meng Huang, Eindhoven (NL); Liyi Zhu, Eindhoven (NL); Yunfei Xu, Eindhoven (NL); Yimeng Qian, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 203 days.

(21) Appl. No.: 15/741,510

(22) PCT Filed: Jun. 7, 2016

(86) PCT No.: PCT/EP2016/062870
§ 371 (c)(1),
(2) Date: Jan. 3, 2018

(87) PCT Pub. No.: WO2017/005435
PCT Pub. Date: Jan. 12, 2017

(65) Prior Publication Data

US 2018/0202640 A1 Jul. 19, 2018

(30) Foreign Application Priority Data

Jul. 6, 2015 (WO) ..... PCT/CN2015/083367
Oct. 29, 2015 (EP) ..... 15192074

(51) Int. Cl.
*F21V 23/00* (2015.01)
*H01Q 9/42* (2006.01)
(Continued)

(52) U.S. Cl.
CPC ..... *F21V 23/003* (2013.01); *F21K 9/232* (2016.08); *F21V 3/02* (2013.01); *F21V 23/0435* (2013.01);
(Continued)

(58) Field of Classification Search
CPC . F21V 23/0435; F21V 23/045; F21V 23/0457
See application file for complete search history.

(56) References Cited

U.S. PATENT DOCUMENTS

2008/0042558 A1* 2/2008 Buchhauser ..... H01L 27/3225 313/504
2010/0188301 A1 7/2010 Kishimoto et al.
(Continued)

FOREIGN PATENT DOCUMENTS

CN 102097676 A 6/2011
CN 104180274 A 12/2014
(Continued)

OTHER PUBLICATIONS

Machine Translation of WO2013031043.*

*Primary Examiner* — Andrew J Coughlin
(74) *Attorney, Agent, or Firm* — Daniel J. Piotrowski

(57) ABSTRACT

The invention provides a lighting device, comprising a light exit chamber (14), delimited by a light exit body (16), a plurality of light sources (20), positioned within the light exit chamber (14), and arranged to emit light in the direction of the light exit body (16), an optical processing element, adapted to process the light emitted from the plurality of light sources (20), and a transparent antenna element (22), extending into the light exit chamber (14) and positioned relative to the plurality of light sources (20) such that each light source is arranged to transmit light toward the antenna element, wherein said transparent antenna element (22) is separate from the optical processing elements, wherein the transparent antenna element (22) being transparent for the
(Continued)

light emitted by the plurality of light sources (20), and the antenna element (22) comprises: a transparent conductive material that is self-supporting.

14 Claims, 6 Drawing Sheets

(51) Int. Cl.

| | |
|---|---|
| ***F21K 9/232*** | (2016.01) |
| ***H01Q 1/44*** | (2006.01) |
| ***F21V 23/04*** | (2006.01) |
| ***H05B 47/19*** | (2020.01) |
| ***H01Q 5/22*** | (2015.01) |
| ***F21V 3/02*** | (2006.01) |
| *H01Q 7/00* | (2006.01) |
| *F21Y 115/10* | (2016.01) |

(52) U.S. Cl.
CPC ..... *H01Q 1/44* (2013.01); *H01Q 5/22* (2015.01); *H01Q 9/42* (2013.01); *H05B 47/19* (2020.01); *F21Y 2115/10* (2016.08); *H01Q 7/00* (2013.01)

(56) References Cited

U.S. PATENT DOCUMENTS

| | | | | |
|---|---|---|---|---|
| 2010/0207506 | A1* | 8/2010 | Kwon | G06K 19/07749 313/323 |
| 2011/0165916 | A1 | 7/2011 | Park et al. | |
| 2013/0063317 | A1 | 3/2013 | Jonsson et al. | |
| 2014/0168020 | A1 | 6/2014 | Stoytchev et al. | |
| 2014/0355246 | A1* | 12/2014 | Yotsumoto | F21V 29/70 362/86 |
| 2015/0070895 | A1* | 3/2015 | Yotsumoto | H04R 1/028 362/253 |
| 2015/0194297 | A1* | 7/2015 | Blees | H01J 61/34 313/594 |

FOREIGN PATENT DOCUMENTS

| | | | |
|---|---|---|---|
| CN | 206130637 | U | 4/2017 |
| JP | 2009027269 | A | 2/2009 |
| JP | 2009265869 | A | 11/2009 |
| JP | 2010152674 | A | 7/2010 |
| JP | 201044341 | A | 9/2011 |
| JP | 2012227021 | A | 11/2012 |
| JP | 2013167559 | A | 8/2013 |
| KR | 101338636 | B1 | 12/2013 |
| WO | WO2013031043 | A1 | 3/2013 |

* cited by examiner

LIGHTING DEVICE WITH WIRELESS CONTROL ELEMENT

CROSS-REFERENCE TO PRIOR APPLICATIONS

This application is the U.S. National Phase application under 35 U.S.C. § 371 of International Application No. PCT/EP2016/062870, filed on Jun. 7, 2016, which claims the benefit of European Patent Application No. 15192074.1, filed on Oct. 29, 2015 and Chinese Patent Application No. PCT/CN2015/083367, filed Jul. 6, 2015. These applications are hereby incorporated by reference herein.

FIELD OF THE INVENTION

The invention relates to a lighting device having wireless control functionality.

BACKGROUND OF THE INVENTION

With the ever increasing prevalence of wireless communication technology in aspects of the modern world, there has been a growing trend in recent years toward the implementation of wireless control (for example radio frequency control) within lighting systems. Wireless control of lighting affords users greater ease and flexibility in the operating of lamps and luminaires, rendering not only the standard operating processes of, for e.g., activating, deactivating, dimming etc, more convenient, but also opening the way for an entire new range of added control functionalities, such as internet-based remote control, timers and routines to control lights, sensor-activated lighting, and implementation of time or activity-based lighting 'moods'.

To incorporate wireless control within a lighting device, it is necessary to build in wireless transceiver components (for example an antenna element) to the body of the device. There are two main options for the installation of the antenna element within a luminaire or lamp. In a first option, the antenna element is housed within a dedicated metal enclosure, located in the main body of the device. In this case however, the wireless (e.g. RF) signal is partially blocked by the metal of the casing, and consequently the sensitivity and transmission range of the device is limited.

To improve the RF signal, the antenna element may alternatively be positioned within the optical (light output) portion of the lighting device, allowing less attenuated signal communication to and from the antenna. Inclusion of the antenna within optical parts however, incurs a consequent impairment of the optical performance of the device. In particular, for wireless controlled lighting devices which incorporate colour-tuning functionality, an antenna element in the optical chamber of the lamp can interfere with the colour mixing operation, with a resultant impact on the quality of the colour output. In addition, the antenna element may cast a noticeable shadow within the output light distribution.

There is therefore a need for a lighting device having wireless control functionality, but with a wireless antenna element which is neither signally attenuated by enclosure within a metal casing, nor situated such that it interferes with the optical output of the device.

US20130063317A1 discloses an antenna integrated into an optical element of a lamp and the antenna can be transparent.

US20100188301A1 discloses a lamp apparatus including an optical unit and a patch antenna. The patch antenna comprises a patch element that formed from a conductor membrane having visible-light transmittance for patch element.

US20140168020A1 discloses a lighting device with a housing and an antenna at least partially enclosed by the housing.

US20110165916A1 discloses a mobile terminal with a case and an antenna located in a transparent portion of the case, the antenna including a transparent sheet and an antenna pattern provided on the transparent sheet.

SUMMARY OF THE INVENTION

In the prior art US20130063317A1, the orientation of the antenna is limited by the orientation of the optical element. This imposed orientation may not meet certain desired specifications for the antenna directivity for achievement of optimal performance of the device.

It would be advantageous to have a structure in which the antenna is not limited by the optical element. To address this concern, the invention is defined by the claims.

According to an aspect of the invention, there is provided a lighting device, comprising a light exit chamber, delimited by a light exit body;

a plurality of light sources, positioned within the light exit chamber, and arranged to emit light in the direction of the light exit body;

an optical processing element, adapted to process the light emitted from the plurality of light sources; and a transparent antenna element, extending into the light exit chamber and positioned relative to the plurality of light sources such that each light source is arranged to transmit light toward the antenna element, wherein said transparent antenna element is separate from the optical processing elements;

wherein the transparent antenna element being transparent for the light emitted by the plurality of light sources, and the antenna element comprises: a transparent conductive material that is self-supporting.

In this aspect, the antenna is separate from optical processing element and thus is more flexible in terms of its positioning and arrangement within the device. Since the antenna element is transparent for the light emitted by the plurality of light sources, the majority of light which falls incident upon it is transmitted across its body, rather than reflected or absorbed, meaning that any potential shadowing incurred by the element on the light output is mitigated in comparison with a standard opaque antenna element. In addition, where the device includes light sources of different colours, the transparent antenna lessens interference on the colour mixing of the different light, resulting in an improved colour performance in comparison with devices containing an opaque or near opaque antenna.

In preferred embodiments, the antenna element may approximate transparency, meaning that transmittance approximates 100%. Since 100% transmittance may be difficult to achieve, preferred examples may provide a translucent antenna element having a transmittance greater than or equal to 80%.

In addition to reducing the overall degree to which the antenna element interferes with any light passing across the light exit chamber, embodiments of the invention also further reduce the optical impact of the antenna through its chosen positioning within the chamber relative to the plurality of light sources. In particular, the antenna in positioned such that it falls within the outgoing light paths of each and every one of the multiple light sources. In this way, any remaining residual interference which the antenna is incurring upon light passing across it is spread evenly across the light outputs of each of the sources of light. In this way any effect on the overall, final optical output of the device is effectively smoothed homogeneously across the total luminous distribution which is produced. This means that any effect which does remain is less noticeable, since it is aggregated uniformly, rather than, for example, isolated to just one portion of the output, for example just one spatial region or just one of a plurality of colour components.

The light exit body may in examples comprise simply a shaped, translucent or transparent light exit surface or light exit window, for instance a translucent or transparent shell which delimits a hollow (or gas-filled) chamber within which the light sources, the optical processing element and the antenna element are located.

The optical processing element may for example be an element for shaping the outgoing luminous distribution of the light sources, for instance a collimating optical element such a lens or reflector element. In some embodiments, the light exit body may also act as or comprise the optical processing element.

The antenna element may be shaped and/or positioned such that for each light source, substantially equal amounts of light are incident on the antenna element. In this way, any absorption or reflection of incident light incurred by the antenna is applied evenly to all of the sources of light, and any detrimental optical effect spread evenly across the total amalgamated luminous output of the device.

In particular examples, the center of the antenna element may be placed around the center of the plurality of light sources, or a symmetry axis of the antenna element may coincide with a symmetry axis of the plurality of light sources.

By the centre of the plurality of light sources is meant an effective or average centre of the plurality of light sources, with the plurality taken as a single combined source of light. For instance, in the case of four light sources, arranged in a square pattern, each defining a corner of the square, the centre of the light sources would be the geometric centre of the formed square. Or in the case of an even circular distribution of light sources, the centre would be the radial centre of said formed circle. Note that these particular geometric arrangements are given as illustrative examples only, and in embodiments, any arrangement (regular or irregular) of the light sources may be used. In each case, the centre is to be understood to be the geometric 'average' or aggregate centre of the entire set of light sources.

By the centre of the antenna element is meant a spatial or geometric centre within a plane perpendicular to the light output direction(s) of the plurality of light sources; it is the centre of the 'shadow' or 'footprint' projected by the antenna element onto the (or a) plane normal to the outgoing light rays of the light sources. For example, in the case of light sources arranged to emit light in an upwards, vertical direction, the centre of the antenna element refers to a horizontal centre of the antenna element. In these examples, the horizontal centre is required to be positioned, or aligned, horizontally with the centre of the light sources.

Positioning the antenna element at the centre of the light sources may ensure the antenna element has a substantially homogenous impact on the light output of each of the light sources, thus reducing the noticeability of its optical effect upon the overall luminous output of the device.

As noted above, the plurality of light sources may be adapted to emit light of different colours. In this case, embodiments of the invention ensure that the optical impact of the antenna is applied evenly to each of the colour components of the generated light output of the device. Were different coloured light sources to be impacted differently, this would be noticeable in the generated luminous output. In particular, it may mean that the overall colour mixing is impaired, such that the generated light is uneven in tone or hue, with certain parts of the generated beam assuming one shade of colour, and others a different shade. In addition to this, the colour reliability in general may suffer, with the device unable to reliably reproduce desired colour shades, since the input colour ratios are disrupted through the uneven optical action of the antenna.

The lighting device may comprise a carrier at the base of the light exit chamber carrying the light sources, and the antenna element may extend from said carrier in a plane perpendicular to a major surface of the carrier carrying the light sources. The carrier may for example be or comprise a PCB for electrically mounting the light sources and/or the antenna element. In a more specific structure, the antenna may be erected with respect to the PCB board.

In examples, the antenna element may be straight, with a projection point on the carrier, or the antenna element may extend between a first point on the carrier and a second point on the carrier, with a projection line on the carrier.

In case the antenna element extends along the carrier plane, the antenna element may be arc shaped, L shaped, or hook shaped.

The antenna element may comprise a first portion extending from the carrier in the plane perpendicular to a major surface, and a second portion which extends from the first portion along a further plane. In a more specific structure, the antenna may be a mushroom shape or an umbrella shape.

The optical transmittance of the antenna element may in examples be equal to or greater than 80%.

The antenna element may have a total length equal to or greater than a quarter of the wavelength of the radiation that the antenna element is adapted to transceive.

The optical processing element may be adapted to alter the distribution and/or propagation direction of electromagnetic waves propagating through the antenna element, and the optical processing element may be preferably integrated with the light exit body. In examples the optical processing element may be adapted to alter the distribution and/or propagation of both the visible light propagating through the antenna element and the wireless communication waves (for example radio frequency waves) propagating through the antenna element. In the case of wireless communication waves, this may improve the sensitivity or wireless range of the device, through either extending the angular reach of the antenna, or acting to strengthen obliquely incoming signals, for instance.

In example embodiments, the device may further comprise a control module for controlling the plurality of light sources, wherein the antenna element is operatively coupled to the control module for receiving control signals for controlling the plurality of light sources. The control module hence facilitates wireless control of the lighting device through command signals received at the antenna. The control module may for example be adapted to independently control the output intensities of each of the light sources. Where the light sources comprise light sources of differing colours, this hence allows for wireless control of the overall colour output of the device, since input intensities of the different colour components may be controlled by the control module, in response to wirelessly transmitted commands.

Provision of a control module allows the device to be operated in a standalone manner, i.e. without incorporation within a broader lighting system, where said broader lighting system may provide the control elements necessary to facilitate interfacing between the antenna element and the plurality of light sources.

According to another aspect, there is provided a lighting control system, comprising:

a lighting device as according to any of the example embodiments described above; and a control device comprising a processor adapted to generate the control signals and a control antenna communicatively coupled to the processor and adapted to transmit the control signals to the antenna element of the lighting device.

The control device may for example comprise a mobile control device, for instance a dedicated remote control unit for controlling the output of the device. Alternatively, the control device may comprise a multi-function mobile device, such as a mobile smartphone or a tablet computer. In further examples still, the control device may comprise a non-mobile control device, for example a desktop computer or other computer hardware.

According to a further aspect, there is provided a luminaire comprising a lighting device according to one or more of the above described embodiments.

These and other aspects of the invention will be apparent from and elucidated with reference to the embodiment(s) described hereinafter.

BRIEF DESCRIPTION OF THE DRAWINGS

Examples of the invention will now be described in detail with reference to the accompanying drawings, in which.

DETAILED DESCRIPTION OF THE EMBODIMENTS

Figure 1:
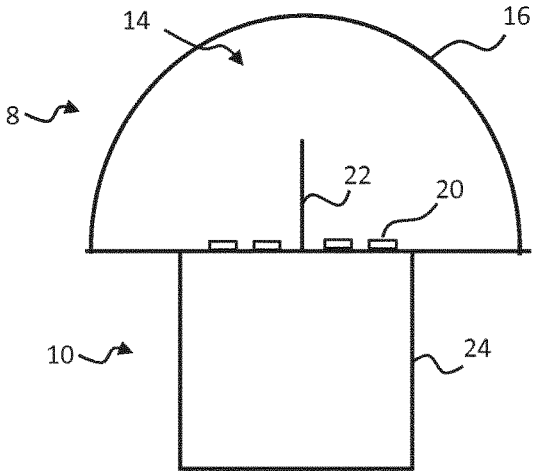
FIG. 1 schematically depicts a lighting device according to a first example embodiment.

It should be understood that the Figures are merely schematic and are not drawn to scale. It should also be understood that the same reference numerals are used throughout the Figures to indicate the same or similar parts.

FIG. 1 schematically depicts a lighting device according to an embodiment. The lighting device comprises a first, upper module 8, the upper module comprising a light exit chamber 14 delimited by a curved light exit window 16, and a second, lower module 10, the second module mated with the first module to define the lighting device. Positioned within the light exit chamber are a plurality of light sources 20, the light sources mounted to a surface at the base of the chamber, and a translucent antenna element 22, the antenna element extending perpendicularly from said surface at the base of the chamber. Preferably the translucent antenna is as transparent as possible, in particular having a transmittance which is greater than or equal to 80%. The light sources may be arranged symmetrically about the base of the antenna element, such that the light sources together define an array of sources, the geometric center which coincides with the mounting location of the antenna.

Each light source 20 is adapted to emit in the direction of the light exit window 16. The central position of the antenna element 22 within the array of light sources means that at least a portion of the light emitted by each of the light sources interacts to some degree with the antenna element on its path toward the light exit window 16. Moreover, the symmetric distribution of the light sources about the antenna element means that the effect of this interaction is spread symmetrically or substantially homogenously over the amalgamated light output of the array as a whole. This means that, for example, any shadowing caused by the antenna element within the generated light output is less noticeable to a user of the device, since it is not concentrated or isolated to any particular point or region within the output luminous distribution, but is dispersed as far as possible across the entire spread of light.

By positioning the antenna element within the light exit chamber, communication signals intended for receipt at the antenna may pass directly through the light exit window and arrive at the antenna without significant attenuation. This contrasts for example with more typical configurations, in which the antenna element is housed within a dedicated metal (or otherwise signally opaque) housing structure, often located for instance within a lower body portion 24 of the device. In this case, signals received by the antenna must pass first through the outer casing of the device housing 24, and then secondarily pass through the casing of the dedicated antenna housing. This causes significant attenuation of the received signals, resulting in loss of signal strength and quality. This in turn reduces the effective communication range of the device, since the loss of signal strength due to attenuation must be compensated for by closer proximity of the device to the transmitter of the control signals.

The present invention hence improves the strength and quality of signals received by the antenna element 22, and extends its effective wireless communication range.

However, this improvement in signal quality is achieved whilst at the same time mitigating the any consequently incurred impact on the optical performance of the device, through firstly providing an antenna 22 which is translucent, and secondly, through locating the antenna within the light exit chamber 14 such that its impact is spread evenly across all of the light sources 20, thereby spreading any deleterious effect homogenously across the luminous output of the device.

According to example embodiments, the light sources 20 may comprise light sources adapted to generated different colour outputs. The different coloured light sources are in this case arranged relative to one another such that the different colours mix together as they propagate through the light exit chamber 14 toward the light exit window 16, resulting in a light output from the device having a single homogenous colour shade and hue.

In one particular example, the plurality of light sources 20 may comprise light sources adapted to generate respectively Red, Green and Blue light outputs, allowing generation of a range of colour shades of light including white light. However any suitable combination of colour sources may be used in alternative examples, as will be apparent to the skilled person.

In these cases, the different colours of light source may be symmetrically arranged about the antenna element 22 such that the light from each is substantially evenly affected by optical interaction with the antenna. In this way, no one colour source is disproportionately dimmed, shadowed or distorted through reflection or absorption by the antenna, and as a result the intended blended colour of the overall output of the device is not distorted through the presence of the antenna.

In addition to ensuring faithful colour generation, the translucency and the symmetric positioning of the antenna 22 with respect to light sources 20 of differing colours also ensures that even mixing of different colours of light within the exit chamber 14 is not unduly disrupted or impeded. Where, for example, an antenna element is provided within the light exit chamber which is opaque, its presence has a significant detrimental effect upon the colour mixing performance within the chamber. This can result for example in a light output from the device which is uneven in its colour, for instance varying in shade or hue across different angular or other spatial regions.

The provision of a symmetrically positioned transparent antenna 22 within the present invention resolves these difficulties, and provides a lighting device having good colour mixing performance.

In certain advantageous embodiments, the antenna element 22 may have a conductive length which is longer than 30 mm and/or at least a quarter of the wavelength of the radiation which it is adapted to receive. At this dimension, the antenna is kept small enough not to impact too greatly upon the optical output of the device, but large enough to ensure that the device has a sizable communication range, for example a range of up to 50 m. The width of the antenna element may for example be greater than or equal to 1.5 mm.

Figure 2:
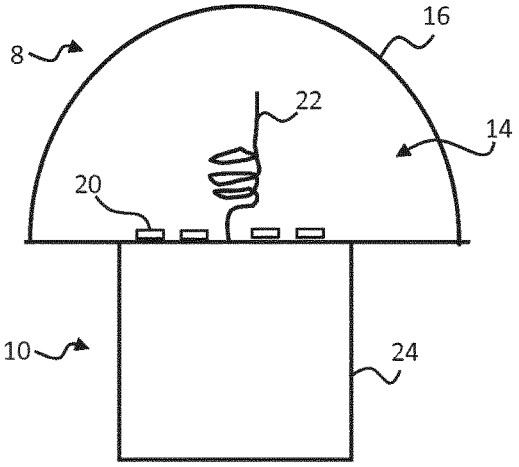
FIG. 2 schematically depicts a lighting device according to a second example embodiment.

In some examples, as illustrated in FIG. 2, the antenna element 22 may be coiled so as to increase compactness of the element within the light output chamber 14, but at the same time maximising the sensitivity of the element by extending its conductively active area. A coiled antenna represents just one of many straightforward examples of a compact geometry in case a long antenna length is needed. Other examples include for instance a curved or folded antenna element.

In examples, the light exit window 16 may include one or more optical processing elements for processing the light emitted by the light sources 20 as it passes through the exit window and out of the device. Such processing elements may allow the intensity distribution of the generated output light profile to be shaped or otherwise manipulated for generation of a particular optical effect. The processing element may for example shape the outgoing light to form an output beam of a particular desired width, for instance. In this case, the processing element may comprise one or more lens or reflector elements for instance.

In other examples, the processing element may be adapted simply to diffuse outgoing light in order to generate an even intensity of light across the light output window. In this case, the processing element may simply comprise one or more frosted window elements adapted to have a diffusing effect on light transmitted across them.

In examples, the optical processing element may be fully integrated with the light exit window, by for example provision of a light exit window which is entirely frosted so as to form a translucent diffusing window. A translucent diffusing window may in some cases be preferable for reasons of aesthetics, since it helps to ensure a homogenous light output from the device, free from any localized bright or dark spots, and also helps to prevent glare for observers.

In other examples, there may be provided dedicated optical processing elements for processing the light emitted by the light sources 20, the dedicated elements distinct and separate from the light exit window 16.

Various options exist for the optical processing element. The optical processing element may for instance comprise a collimating element, for instance a TIR or reflector-based collimator, or alternatively a Fresnel lens or Fresnel foil. The optical processing element may comprise one or more lens elements, for example converging lenses. The optical element may comprise one or more mirror or reflector elements for redirecting or focusing light, either to achieve a collimating effect, or to achieve a different optical effect.

In at least some embodiments, the lighting device may further comprise a control module for controlling the plurality of light sources 20, the control module operatively coupled to the antenna element 22 for receiving control signals for controlling the light sources. The control module hence facilitates wireless operation of the lighting device through remotely transmitted control signals.

The control module may be adapted to interpret control signals received at the antenna element 22 and to in response control one or more light output parameters of the plurality of light sources 20. For example, the control module may be adapted to allow independent control of output intensities of each of the light sources. The output intensities of the light sources might, according to certain control modes, be varied in concert, to thereby change the overall output intensity of the lighting device (i.e. to allow dimming of the light output of the lighting device). According to other control modes, the output intensities of the plurality of light sources may be respectively varied in different ways. In embodiments comprising differently coloured light sources, for example, this may allow for the colour output of the device as a whole to be tuned through changing the relative intensities of the different colour inputs.

In some examples, the control module may comprise circuitry adapted to interpret signals received at the antenna element 22 and to control in response various parameters of the light sources 20. In other examples, the control module may comprise a computer processor element adapted to execute computer program instructions stored for example on a provided computer readable storage medium.

Provision of a control module allows embodiments of the device to be operated in a standalone manner with respect to wireless control functionality. However, it should be understood that this is not an essential feature of the invention. It is equally feasible for example that embodiments of the lighting device may include an external connection terminal (not shown in the exemplary figures), said terminal configured to relay signals received at the antenna element 22 to one or more control modules of a broader lighting control system. The control module of the lighting control system may be adapted to interpret the relayed signals and to generate in response control commands to be relayed back to the lighting device for controlling one or more light output parameters of the light sources 20.

Within such an embodiment, the lighting system may incorporate a plurality of lighting devices in accordance with embodiments, each lighting device communicatively coupled (either directly or indirectly) to a single central control module for example. In this case, the antenna element 22 of any single lighting device may feasibly be used to detect and receive control signals intended for controlling any one of the lighting devices comprised by the control system. Such signals may simply be relayed to the central control module, from where control commands may be generated in response and relayed to the particular lighting device for which the control signals were intended.

In this example, it may be necessary that control signals transmitted to lighting devices be encoded with identification information indicating the intended recipient lighting device of the signal, to allow determination by the central control module as to which lighting device to address in response to the received signal.

Figure 3:
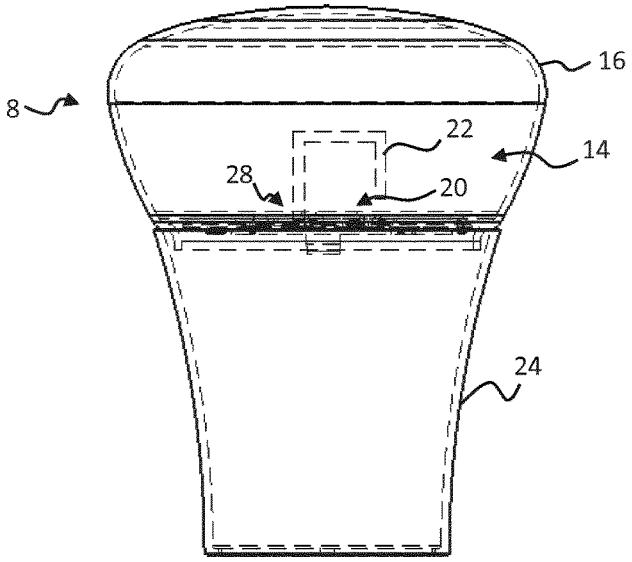
FIG. 3 schematically depicts a cross-sectional view through a lighting device according to a third example embodiment.
Figure 4:
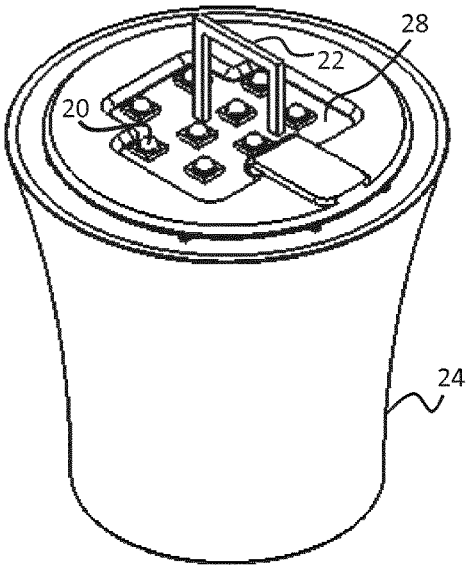
FIG. 4 schematically depicts a perspective view of the third example lighting device embodiment.

In FIGS. 3 and 4 are schematically depicted cross-sectional and perspective views respectively of an example lighting device according to an embodiment. The example lighting device comprises a tapered lower body portion 24 mated co-operatively with an upper body portion 8, the upper body portion comprising a central light exit chamber 14 delimited and bounded by a translucent shell 16, forming a light exit window for the device. At the base of the light exit chamber, at the junction between the lower body portion and the upper body portion, a plurality of light sources 20 are arranged arrayed about the base of a U-shaped antenna element 22, the antenna element extending from the base of the chamber into its central cavity. The light sources and the antenna element are electrically coupled to a carrying printed circuit board (PCB) 28.

In FIGS. 5 to 19 are illustrated a variety of example geometric arrangements of lighting elements 20 and a corresponding example antenna 22 configuration for mitigation of the optical impact of the antenna on the outgoing light distribution.

Figure 5:
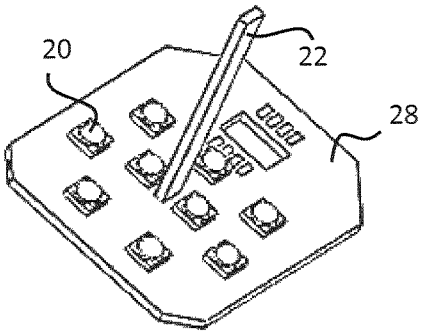
FIG. 5 schematically depicts a first example arrangement of the plurality of light sources and the antenna element according to an example embodiment.
Figure 6:
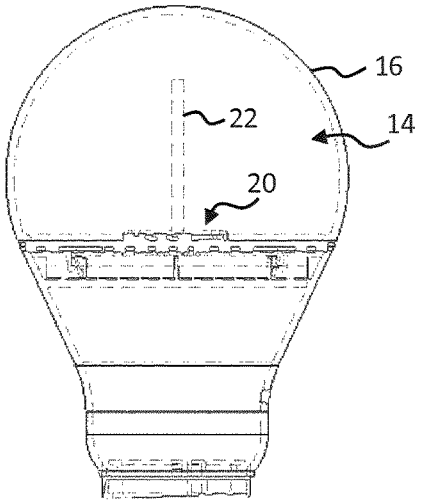
FIG. 6 schematically depicts a cross-sectional view of the first example antenna and light source arrangement in situ within an example lighting device.

In FIG. 5 is shown a first example antenna 22 and light source 20 arrangement according to an example embodiment. FIG. 6 shows a cross-sectional view of the antenna and light source arrangement in situ within an example lighting device. An array of nine lighting elements 20 are mounted in an irregular heptagonal pattern upon a carrying PCB 28. Seven of the nine elements define effective vertices of an outer heptagon shape, with the remaining two lighting elements positioned symmetrically within the center of the thus defined heptagonal annulus. A linear, 'stick-shaped' antenna element 22 is further mounted by a first of two ends to the PCB surface, and arranged extending perpendicularly from said surface into the surrounding light exit chamber 14. The antenna is mounted to a point on the PCB falling at the centroid of the heptagon shape defined by the arrayed lighting elements. In this way, the optical impact of the antenna (through for example reflection or absorption) is approximately averaged (evened out) across the amalgamated light output of the combined array, where by approximately averaged is meant that variations in impact on individual light contributions generated by individual light sources are minimized.

Figure 7:
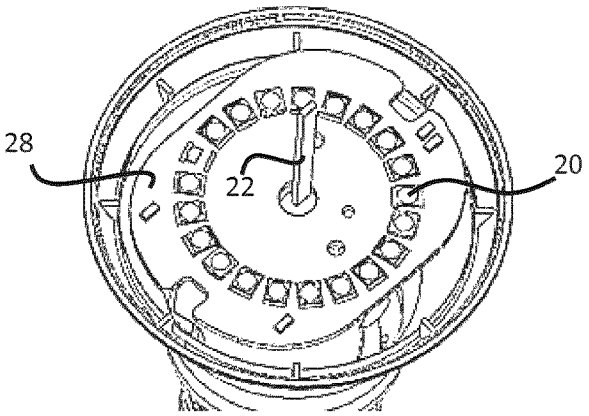
FIG. 7 schematically depicts a first view of a second example arrangement of the plurality of light sources and the antenna element according to an example embodiment.
Figure 8:
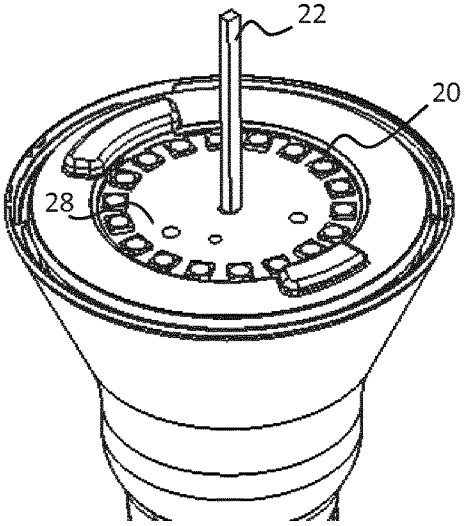
FIG. 8 schematically depicts a second view of the second example arrangement of the plurality of light sources and the antenna element according to an example embodiment.

In FIGS. 7 and 8 are shown perspective views of a second example antenna 22 and light source 20 arrangement according to an embodiment. A plurality of lighting elements 20 are arranged in a circular ring pattern upon the carrying PCB 28, with a stick shaped antenna element mounted at the the radial center of the thus defined ring, extending perpendicularly from the PCB into the surrounding light exit chamber. Once again, the antenna element is positioned such that it lies at a geometric center of the (in this case circular) pattern defined by the lighting elements 20.

Figure 9:
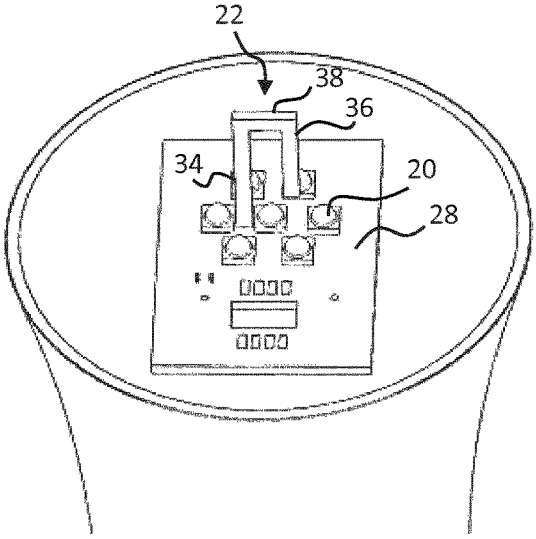
FIG. 9 schematically depicts a third example arrangement of the plurality of light sources and the antenna element according to an example embodiment.

In FIG. 9 is shown a third example antenna 22 and light source 20 arrangement according to an embodiment. In this case, the lighting elements 20 are mounted to the carrying PCB 28 to form a regular hexagonal pattern, with six light sources 20 defining the six vertices of the hexagon and a seventh positioned at the center of the defined shape. Here, a disrupted U-shaped (or hook shaped) antenna is provided, mounted to the PCB by a first of two ends. The antenna extends upwards from the mounting point, to form a first 'leg' 34 of the U-shape, before extending perpendicularly from the first leg to form a cross-bar portion 38, and finally extending perpendicularly downward from the cross-bar portion 38 to form a second leg 36, the second leg being shorter than the first leg 36 and being held suspended above the array of antenna elements beneath.

According to this configuration, the disrupted U-shaped antenna 22 is arranged substantially symmetrically within the defined hexagonal array, having a plane of reflective symmetry (parallel with the extension of the crossbar element 38 of the antenna) which coincides with a plane of symmetry of the hexagonal array of lighting elements.

Figure 10:
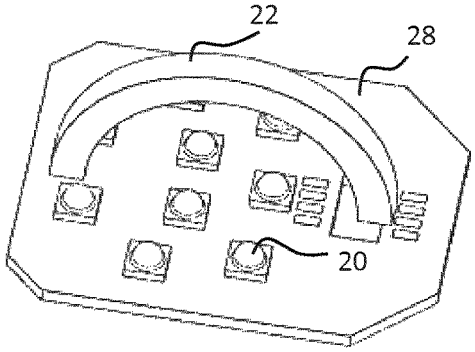
FIG. 10 schematically depicts a first view of a fourth example arrangement of the plurality of light sources and the antenna element according to an example embodiment.
Figure 11:
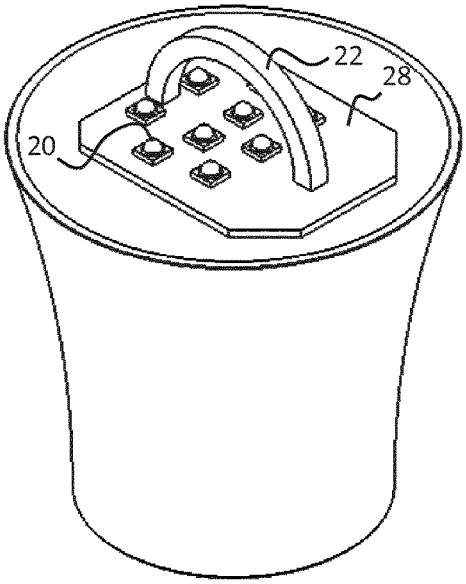
FIG. 11 schematically depicts a second view of the fourth example arrangement of the plurality of light sources and the antenna element according to an example embodiment.
Figure 12:
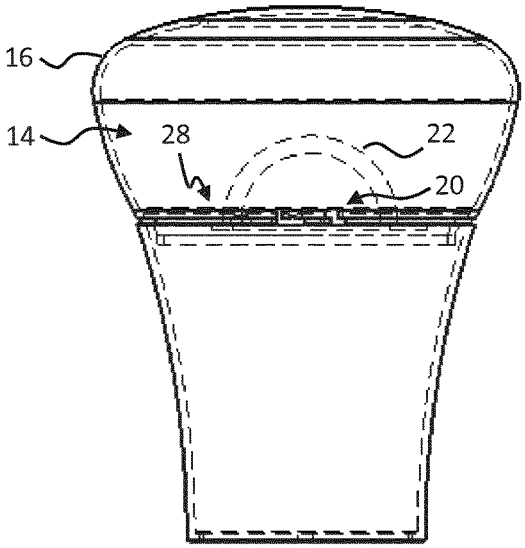
FIG. 12 schematically depicts a cross-sectional view of the fourth example antenna and light source arrangement in situ within an example lighting device.

In FIGS. 10 and 11 are shown perspective views of a fourth example antenna 22 and light source 20 arrangement according to an embodiment and FIG. 12 shows a cross-sectional view of the antenna and light source arrangement in situ within an example lighting device. In this embodiment, the lighting elements 20 are mounted to the PCB 28 in the same irregular heptagonal pattern as in the example configuration of FIG. 5. However, in the present case, an arc-shaped antenna element 22 is provided in place of the stick-shaped antenna of the FIG. 5 example. The antenna extends in an arc between two respective mounting points on the PCB, the mounting points located on opposing sides of the defined heptagon shape. The arc of the antenna hence lies within a plane of approximate (or pseudo) symmetry of the array of light sources, meaning that its optical effect is substantially evenly distributed across the width of the array.

Figure 13:
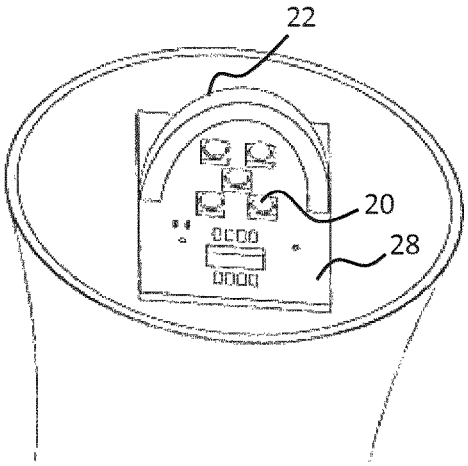
FIG. 13 schematically depicts a first view of a fifth example arrangement of the plurality of light sources and the antenna element according to an example embodiment.
Figure 14:
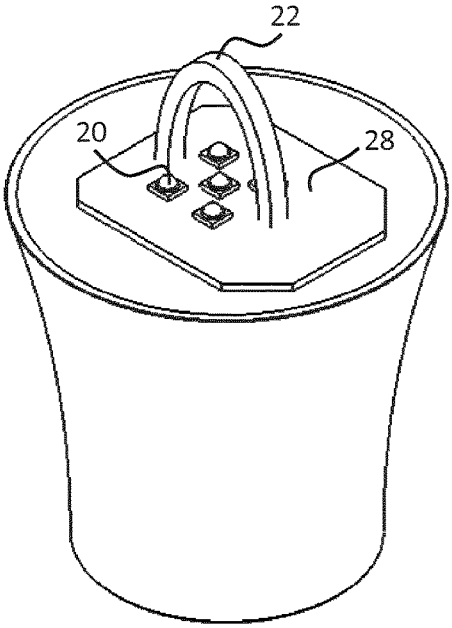
FIG. 14 schematically depicts a second view of the fifth example arrangement of the plurality of light sources and the antenna element according to an example embodiment.

In FIGS. 13 and 14 are shown perspective views of a fifth example antenna 22 and light source 20 arrangement according to an embodiment. Here a square arrangement of light sources 20 is provided, with four light sources defining vertices of an outer square shape, and a fifth positioned at the centre of the thus defined square. As in the example of FIGS. 10-12, an arc-shaped antenna 22 is provided. The arc-shaped antenna extends between two respective mounting points on the PCB 28, the mounting points positioned on either side of the array, and aligned with a horizontal line of reflective symmetry of the array.

Figure 15:
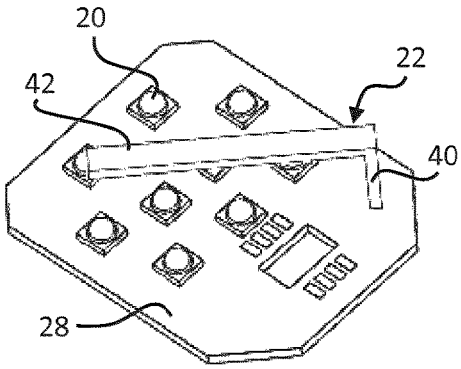
FIG. 15 schematically depicts a sixth example arrangement of the plurality of light sources and the antenna element according to an example embodiment.

In FIG. 15 is shown a sixth example antenna 22 and light source 20 arrangement according to an embodiment. The light sources are arranged according to the same irregular heptagonal pattern as in the examples of FIGS. 5, 10 and 11. In this case, however, the antenna element 22 is an L-shaped antenna element, comprising a first 'leg' portion 40 extending perpendicularly from a mounting point on the carrying PCB 22, and a second 'arm' portion 42 extending perpendicularly from the first portion, over the top of the lighting elements arranged beneath. The antenna is oriented such that the arm portion 42 extends between two diagonally opposite points at either side of the array, crossing over the geometric centre of the array as it does so.

Figure 16:
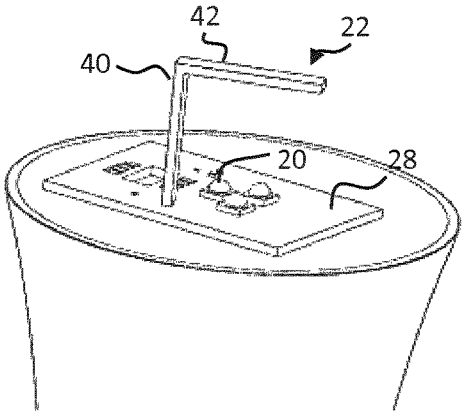
FIG. 16 schematically depicts a first view of a seventh example arrangement of the plurality of light sources and the antenna element according to an example embodiment.
Figure 17:
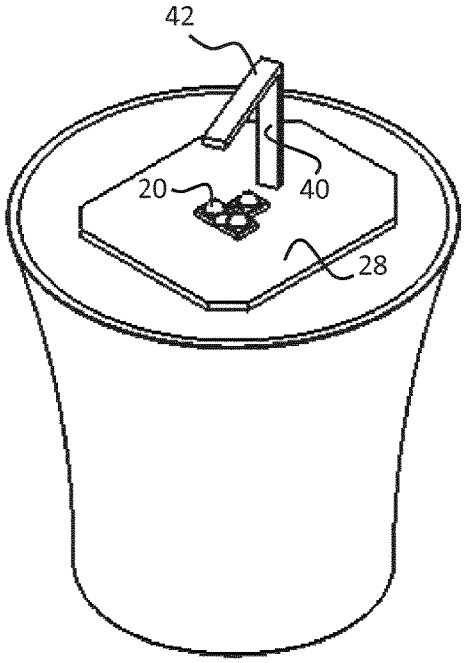
FIG. 17 schematically depicts a second view of the seventh example arrangement of the plurality of light sources and the antenna element according to an example embodiment.
Figure 18:
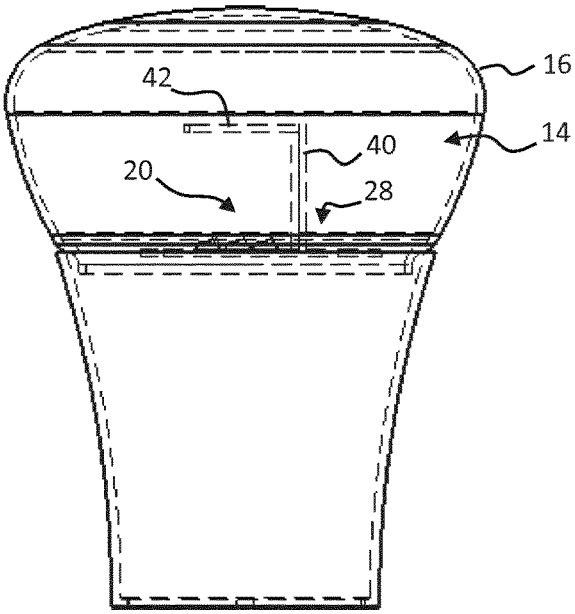
FIG. 18 schematically depicts a cross-sectional view of the seventh example antenna and light source arrangement in situ within an example lighting device.

In FIGS. 16 and 17 are shown views of a seventh example antenna 22 and light source 20 arrangement according to an embodiment, and FIG. 18 shows a cross-sectional view of the antenna and light source arrangement in situ within an example lighting device. Here, a triangular arrangement of three lighting elements 20 is provided mounted to the PCB 28. An L-shaped antenna element 22 is provided, having an arm portion 42 which extends over the light sources such that it coincides with the centroid of the triangle.

Figure 19:
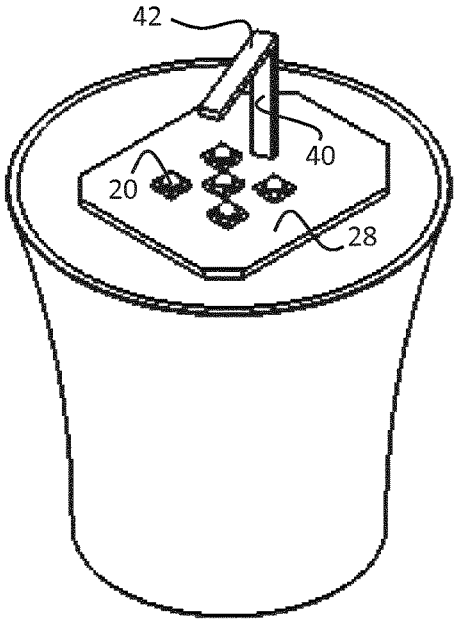
FIG. 19 schematically depicts an eighth example arrangement of the plurality of light sources and the antenna element according to an example embodiment.

In FIG. 19 is shown an eighth example antenna 22 and light source 20 arrangement according to an embodiment. Here, the light sources 20 are arranged according to the same square pattern as in the example of FIGS. 13 and 14. An L-shaped antenna element 22 is provided having an arm portion 42 which extends over the light sources such that it coincides with the centroid of the square pattern.

In at least certain examples of this arrangement, the three lighting elements 20 may comprise lighting elements adapted to generate different respective colour outputs, to allow for multi-colour functionality. According to at least one non-limiting example, these may include a Red, Green and Blue lighting element, but other example combinations may also be advantageously employed.

The antenna and light source arrangements depicted in FIGS. 5 to 19 represent just one non-limiting set of examples of such arrangements. Any suitable shape of antenna 22 may in alternative examples be combined with any suitable arrangement of light sources 20 to provide an optical arrangement in which the optical effect of the antenna element on the light output of the device is minimized. In examples, the particular combination of antenna element shape/size and lighting element pattern and arrangement may be chosen according to the particular wavelength of radiation to be transmitted to the antenna and/or wavelength of light to be emitted by the light sources.

Various options exist for the material and composition of the antenna element 22.

According to a first set of embodiments, the antenna element 22 may be formed of a conductive stripe or conductive film attached atop a transparent substrate. The transparent substrate may, by way of non-limiting example be made of Polycarbonate, PMMA, PET, glass or any other suitable transparent material. The conductive stripe or film may be made, for example, of Indium Tin Oxide (IDO), Fluorine-doped Tin Oxide (FTO), Aluminium Zinc Oxide (AZO), or any other suitable material.

According to a second set of embodiments, the antenna element 22 may be formed through printing conductive ink onto the surface of a transparent substrate, to form a conductive layer over the top of the transparent substrate.

According to a third set of embodiments, the antenna element 22 may be formed singly of a transparent self-supporting sheet which is itself conductive. One example of this kind of antenna can be obtained by: coating/depositing/printing the transparent conductive material in a substrate into a substantial thickness like 0.5 mm, for example by several times of processing; and then remove the substrate by for example etching. The transparent conductive can be ITO or graphene. Those skilled in the art would also understand that there are or will be other transparent conductive materials that can be formed into an antenna sufficiently hard to support itself in a proper processing. The present application is not limited by the specific material.

In preferred examples, the antenna element 22 may have a transmittance of greater than or equal to 80%.

In at least some examples, an antenna element 22 may be provided which is translucent rather than transparent, for example for reasons of production cost. In this case the antenna element may be formed of a conductive substrate attached atop a translucent substrate. Any suitable material may be used for the translucent substrate.

The antenna 22 in preferred examples may be adapted to receive radio frequency waves. Radio frequency waves have a frequency range of approximately 300 GHz to 3 kHz and are ideal for short-medium range communication applications. However, it will be appreciated than in other embodiments, different ranges of wireless frequencies may be employed, for example microwave frequencies or infrared frequencies.

As discussed above, by positioning the antenna element 22 within the optical chamber 14 of the device, attenuation of wireless signals transmitted to or from the antenna is significantly reduced and as a result the wireless operating range of the device is extended. The resultant distribution of the radiation is approximately uniform across all angular directions, and the communication range of the device is extended to approximately 50 meters, which for instance is suitable for most domestic applications.

Figure 20:
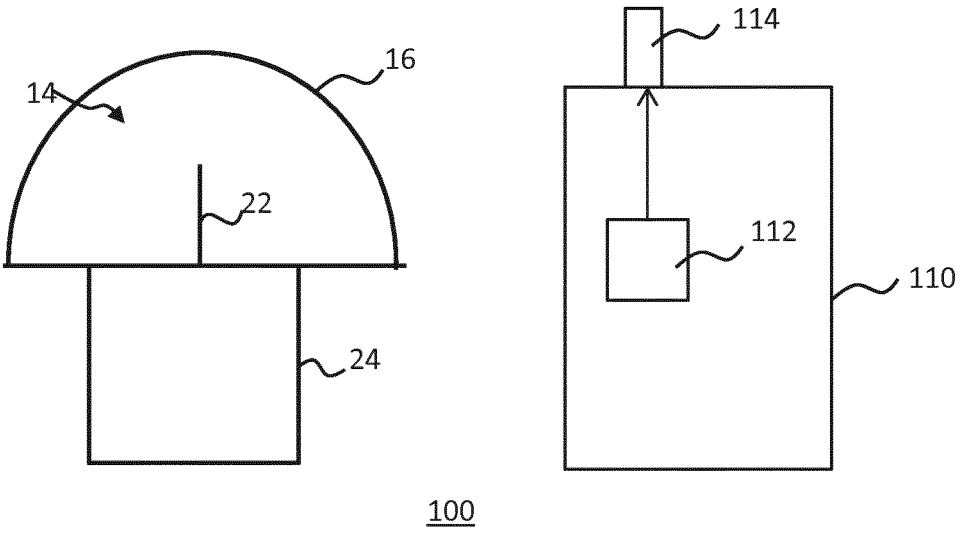
FIG. 20 schematically depicts a lighting control system according to an example embodiment.

In FIG. 20 is schematically depicted an example lighting system 100 according to an aspect of the invention, comprising a lighting device in accordance with one or more of the embodiments described above, and a control device 110 for wirelessly controlling the lighting device. The control device 110 comprises a processor 112, adapted to generate control signals, and a control antenna 114 communicatively coupled with the processor 112 adapted to transmit the generated control signals to the antenna element 22 of the lighting device.

In at least some embodiments, the control device 110 may be a mobile or remote control device, for example a hand-held remote control device, allowing control of the device by a user in any desired location (within the communication range of the device). In examples, the control device may comprise a dedicated remote control unit for controlling the output of the device. Alternatively, the control device may comprise a multi-function mobile device, such as a mobile smartphone or a tablet computer.

In further examples still, the control device may comprise a non-mobile control device, for example a desktop computer or other computer hardware.

The control device 110 may in preferred embodiments comprise one or more user input elements to allow a user to control the processor to generate desired control signals to be transmitted to the lighting device.

In one or more embodiments, the control device may further comprise a computer program product comprising a computer readable storage medium having computer readable program instructions embodied therewith, for when executed on the processor, causing the processor to generate the control signals.

According to an aspect of the invention, there may be provided a kit of parts for creating one or more embodiments of the lighting control system described above. The kit of parts may comprise for a lighting device in accordance with embodiments disclosed above, in addition to a computer program product comprising a computer readable storage medium having computer readable program instructions embodied therewith, for when executed on the processor, causing the processor to generate the control signals.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A lighting device, comprising a light exit chamber, delimited by a light exit body;

a plurality of light sources, positioned within the light exit chamber, and arranged to emit light in the direction of the light exit body;

at least one optical processing element, adapted to process the light emitted from the plurality of light sources; and a transparent antenna element, extending into the light exit chamber and positioned relative to the plurality of light sources such that each light source is arranged to transmit light toward the antenna element, wherein said transparent antenna element is separate from each of the optical processing elements, wherein the transparent antenna element being transparent for the light emitted by the plurality of light sources, and the antenna element comprises:

a transparent conductive material that is self-supporting;

wherein the antenna element is shaped and/or positioned such that each light source emits light incident on the antenna element and for each light source, substantially equal amounts of light are incident on the antenna element.

2. A lighting device as claimed in claim 1, wherein the center of the antenna element is placed around the center of the plurality of light sources, or a symmetry axis of the antenna element coincides with a symmetry axis of the plurality of light sources.

3. A lighting device as claimed claim 1, wherein the plurality of light sources is adapted to emit light of different colours.

4. A lighting device as claimed in claim 1, wherein the antenna element is manufactured by:

coating/depositing/printing a transparent conductive material in a substrate into a substantial thickness; and removing the substrate.

5. A lighting device as claimed in claim 1, wherein the transparent antenna element have a transmittance of greater than or equal to 80%.

6. A lighting device as claimed in claim 1, wherein the antenna element has a total length equal to or greater than a quarter of the wavelength of the radiation that the antenna element is adapted to transceive.

7. A lighting device as claimed in claim 1, wherein at least one of the optical processing elements is preferably integrated with the light exit body and is adapted to alter the distribution and/or propagation direction of light propagating through the antenna element.

8. A lighting device as claimed in claim 1, further comprising a control module for controlling the plurality of light sources, wherein the antenna element is operatively coupled to the control module for receiving control signals for controlling the plurality of light sources.

9. A lighting control system, comprising:

a lighting device as claimed in claim 6; and a control device comprising a processor adapted to generate the control signals and a control antenna communicatively coupled to the processor and adapted to transmit the control signals to the antenna element of the lighting device.

10. A luminaire comprising a lighting device of claim 1.

11. A lighting device, comprising a light exit chamber, delimited by a light exit body;

a plurality of light sources, positioned within the light exit chamber, and arranged to emit light in the direction of the light exit body;

at least one optical processing element, adapted to process the light emitted from the plurality of light sources; and a transparent antenna element, extending into the light exit chamber and positioned relative to the plurality of light sources such that each light source is arranged to transmit light toward the antenna element, wherein said transparent antenna element is separate from each of the optical processing elements, wherein the transparent antenna element being transparent for the light emitted by the plurality of light sources, and the antenna element comprises:

a transparent conductive material that is self-supporting wherein the lighting device comprises a carrier at the base of the light exit chamber carrying the light sources, and wherein the antenna element is mounted on the carrier and extends from said carrier in a plane perpendicular to a major surface of the carrier carrying the light sources.

12. A lighting device as claimed in claim 11, wherein the antenna element is straight, or the antenna element extends between a first point on the carrier and a second point on the carrier.

13. A lighting device as claimed in claim 12, wherein the antenna element is arc shaped, L shaped, or hook shaped.

14. A lighting device as claimed in claim 11, wherein the antenna element comprises a first portion extending from the carrier in said plane, and a second portion which extends from the first portion along a further plane.

* * * * *